US006111959A

United States Patent [19]

Taylor

[11] Patent Number: 6,111,959

[45] Date of Patent: Aug. 29, 2000

[54] SOUND SPREADER

[75] Inventor: Stephen Francis Taylor, Santa Monica, Calif.

[73] Assignee: Taylor Group of Companies, Inc., Santa Monica, Calif.

[21] Appl. No.: 08/961,380

[22] Filed: Oct. 30, 1997

Related U.S. Application Data

[60] Provisional application No. 60/028,800, Oct. 31, 1996.

[51] Int. Cl.[7] ..... H04R 5/00

[52] U.S. Cl. ..... 381/17

[58] Field of Search ..... 381/18, 22, 23, 381/1, 17, 19, 27, 61, 300, 99

[56] References Cited

U.S. PATENT DOCUMENTS 4,497,023 1/1985 Moorer .
4,597,100 6/1986 Grodinsky et al. ..... 381/99
4,622,689 11/1986 Hobrough .
4,685,134 8/1987 Wine .
4,736,333 4/1988 Mead et al. .
4,933,768 6/1990 Ishikawa et al. .
5,095,798 3/1992 Okada et al. .
5,233,664 8/1993 Yanagawa et al. .
5,386,082 1/1995 Higashi .
5,459,790 10/1995 Scofield et al. .

*Primary Examiner*—Vivian Chang
*Attorney, Agent, or Firm*—Gates & Cooper

[57] ABSTRACT

A sound spreader accepts one or more input signals and generates a plurality of output signals, wherein the output signals are transmitted to a plurality of transducers each generating acoustical energy that together comprise a sound field. The spreader placing sounds within the sound field by means of selection and delay of the output signals. The spreader also detects changes in the input signals and alters the output signals accordingly to alter a subjective placement of the acoustical energy in the sound field.

18 Claims, 2 Drawing Sheets

SOUND SPREADER

CROSS-REFERENCE TO RELATED PATENTS AND APPLICATIONS

This application claims the benefit under 35 U.S.C. § 1.119(e) of provisional application Ser. No. 60/028,800, entitled "SOUND SPREADER," filed on Oct. 31, 1996, by Stephen F. Taylor, which application is incorporated herein by reference.

This application is related to application Ser. No. 08/607,830 now U.S. Pat. No. 5,689,570, entitled "SOUND REPRODUCING ARRAY PROCESSOR SYSTEM," filed on Feb. 27, 1996, by Stephen F. Taylor, which is a divisional of U.S. Pat. No. 5,517,570, entitled "SOUND REPRODUCING ARRAY PROCESSOR SYSTEM," filed on Dec. 14, 1993, issued May 14, 1996, by Stephen F. Taylor, both of which are incorporated herein by reference.

This application is related to application Ser. No. 08/713,794 now U.S. Pat. No. 5,812,675, entitled "SOUND REPRODUCING ARRAY PROCESSOR SYSTEM," filed on Sep. 13, 1996, by Stephen F. Taylor, which is a continuation of U.S. Pat. No. 5,590,207, entitled "SOUND REPRODUCING ARRAY PROCESSOR SYSTEM," filed on May 17, 1994, issued on Dec. 31, 1996, by Stephen F. Taylor, which is a continuation-in-part of U.S. Pat. No. 5,517,570, entitled "SOUND REPRODUCING ARRAY PROCESSOR SYSTEM," filed on Dec. 14, 1993, issued May 14, 1996, by Stephen F. Taylor, all of which are incorporated herein by reference.

This application is related to application Ser. No. 08/631,705 now U.S. Pat. No. 5,745,584, entitled "SOUND REPRODUCING ARRAY PROCESSOR SYSTEM," filed on Apr. 9, 1996, by Stephen F. Taylor, which is a continuation-in-part of U.S. Pat. No. 5,590,207, entitled "SOUND REPRODUCING ARRAY PROCESSOR SYSTEM," filed on May 17, 1994, issued on Dec. 31, 1996, by Stephen F. Taylor, which is a continuation-in-part of U.S. Pat. No. 5,517,570, entitled "SOUND REPRODUCING ARRAY PROCESSOR SYSTEM," filed on Dec. 14, 1993, issued May 14, 1996, by Stephen F. Taylor, all of which are incorporated herein by reference.

BACKGROUND OF THE INVENTION

1. Field of the Invention

This invention relates in general to audio systems, and in particular to a sound spreader for generating multiple output signals for a plurality of transducers.

2. Description of Related Art

With the continuing evolution of digital audio technology, breakthroughs seem to be commonplace in sound reproduction methods. In truth, however, it is not really possible to introduce real innovation into audio entertainment without controlling the recording/playback chain.

SUMMARY OF THE INVENTION

To overcome the limitations in the references described above, and to overcome other limitations that will become apparent upon reading and understanding the present specification, the present invention discloses a sound spreader that accepts one or more input signals and generates a plurality of output signals, wherein the output signals are transmitted to a plurality of transducers each generating acoustical energy that together comprise a sound field. The spreader places sounds within the sound field by means of selection and delay of the output signals. The spreader also detects changes in the input signals and alters the output signals accordingly to alter a subjective placement of the acoustical energy in the sound field.

BRIEF DESCRIPTION OF THE DRAWINGS

Referring now to the drawings in which like reference numbers represent corresponding parts throughout.

DETAILED DESCRIPTION OF THE PREFERRED EMBODIMENT

Figure 1A:
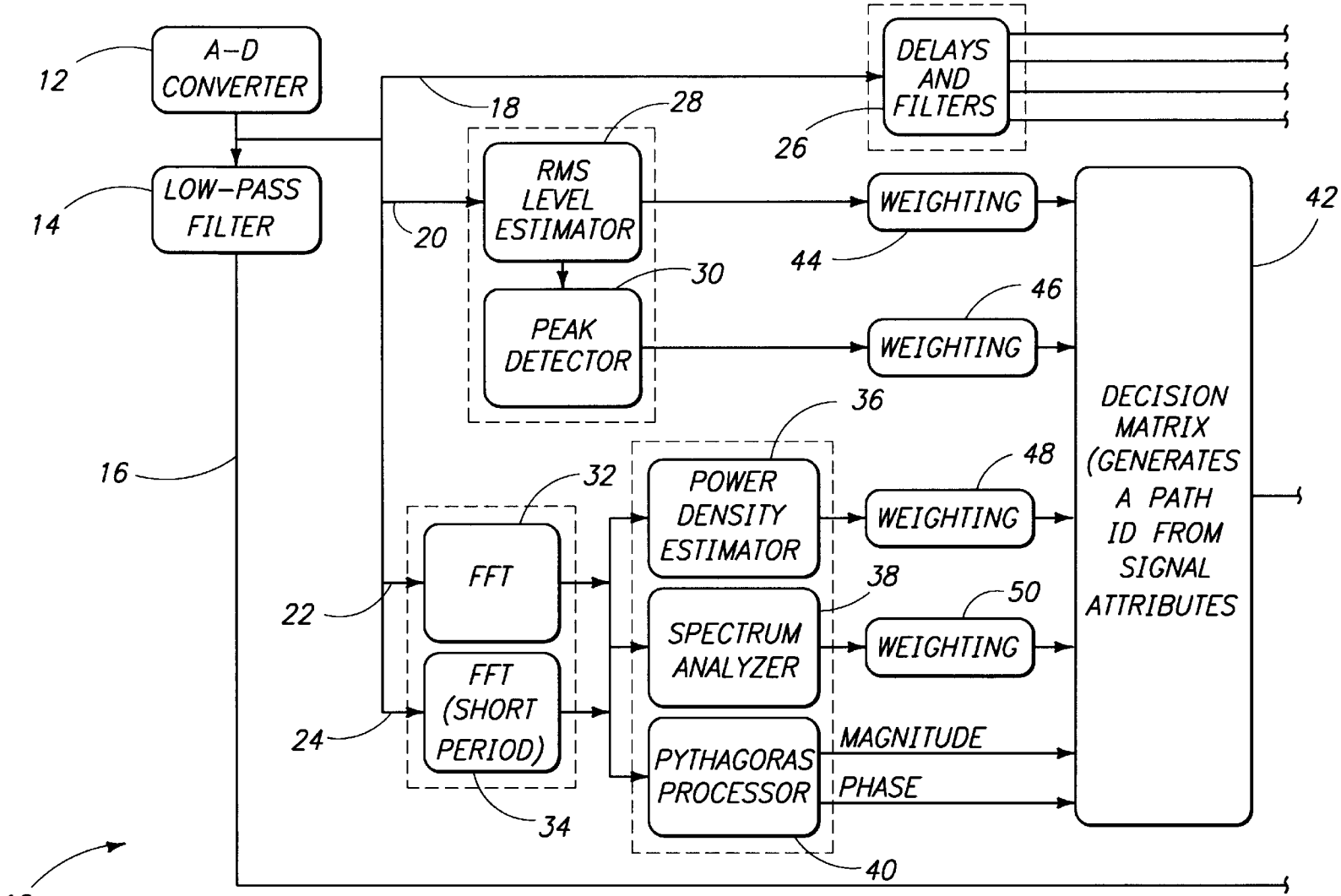
FIGS. 1A and 1B depict block diagram illustrating the components of a sound spreader according to the present invention.

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

OVERVIEW

The present invention comprises a sound spreader for generating multiple output signals for a plurality of transducers. For example, the sound spreader could be used to generate multiple data streams for the sound reproducing array processor system described in the patents and patent applications listed in the Cross-Reference section above, all of which are incorporated herein by reference. The term "spreader" is an umbrella term used to describe the general concept of the present invention, although there are different embodiments of the spreader.

One embodiment comprises a "static spreader" that does not enhance games (arcade, home game platforms, etc.). The static spreader places sounds in a sound field (not a collection of point sources) and may use various amounts of delay and even reverberation on the feed to a given speaker. For example, a speaker in a three-channel (left-center-right) static system might be fed equal parts left and right, each delayed by a certain number of milliseconds, at a level of −12 dB with respect to the nominal program level. The same speaker may also be delivering the center channel undelayed at a relative level of −6 dB. The static spreader relies a great deal on psycho-acoustic phenomena to achieve various results, and relies a great deal on delay and mixing at the digital signal processor.

Another embodiment comprises a "dynamic spreader" or "pather" that is configured for use with games, and which detects audio scene changes, game control states, etc. Generally, such changes will occur as a result of a sound's having been played by the game platform as appropriate to the game state. To give a hypothetical example, in a fighter-pilot form of game, the launch of a local missile usually generates a distinct sound which varies the timbral aspect of the game's general sound for the duration of the missile flight and warhead detonation. The object of the dynamic spreader is to change the subjective placement of the missile's sounds during flight. In short, the missile sound moves, say from back to front. The paths, or "vectors" selected for a given timbral change in a game's audio output are determined either algorithmically or by lookup. Direction and amplitude of the sound movement (not "apparent" sound movement; the effect is a multispeaker pan, so the paths actually do move the sound from speaker to speaker) are selected and implemented by interpretation of an identification attribute provided by the timbral analyzer. The path sounds are superimposed on the static spreader effects, so that there are parallel processes in the system. None of the static spreader ceases to function when the dynamic spreader is in use.

To summarize:

1. Two-channel sources which are not games use the static spreader. The center and rear channels are synthesized.
2. Three-, four-, and five-channel sources, as well as those which bear an additional low-frequency channel, use the static spreader.

Note that the above uses are primarily experiential enhancers and are also a means to broaden the (generally) small area of a room in which stereo or multichannel imaging is best.

Arcade and home-platform games use the static spreader, and, optionally, the pather. The pather can produce some quite exotic effects and is therefore not generally used with more sedate sources of audio program such as those described in the paragraphs above. There is, however, no reason why it could not be so used if desired.

SOUND SPREADER

Figure 1B:
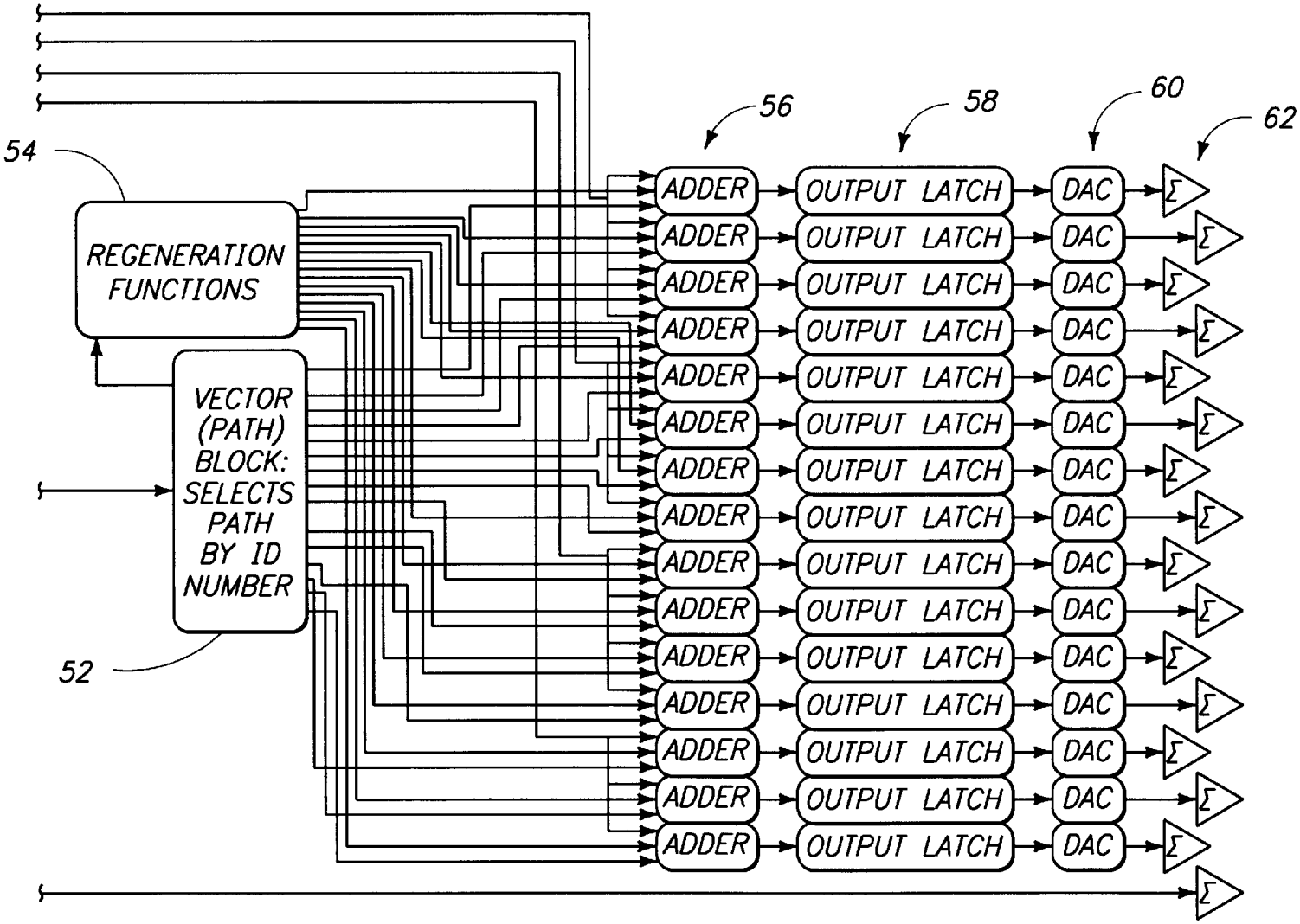

FIGS. 1A and 1B depict a block diagram illustrating the components of a sound spreader 10 according to the present invention. The spreader 10 accepts any kind of audio input, such as two channel stereo or five or eight channel surround sound, from any type of audio device and generates a 16-channel data stream for use with the array of speakers in the sound bubble described in the patents and applications cited in the Cross-Reference section above, all of which are incorporated by reference herein. Of course, those skilled in the art will recognize that the sound spreader 10 could generate any number of channels, and thus is in no way limited to a 16 channel output.

The spreader 10 accepts normal audio input and separates, using digital signal processing techniques, "walla" or background sounds or quiescent noise from impulse sounds. In any input stream, there is a certain amount of noise or walla that occurs. There are also periodic impulse sounds. In video games, for example, these impulse sounds are the result of interaction or events that occur within the game. Through experimentation, it has been discovered that these impulse sounds are typically generated not less than 60 milliseconds apart, which provides for ample processing time to synthesize and generate a large number of output channels for the sound bubble.

The present invention evaluates the nature of these impulses and chooses a trajectory for vectoring the impulse across the array of speakers in the sound bubble. First, the spreader 10 takes the walla or quiescent noise and spreads it around to all the speakers in the array, so that the noise is spread evenly throughout the various channels. The impulse sounds are then processed so that they are vectored in a three-dimensional manner through the array of speakers of the sound bubble. This creates a three-dimensional acoustical effect within the array of speakers in the sound bubble.

Analog audio signals are received at an A-to-D converter 12, which converts the analog signals to digital samples. Typically, four analog audio inputs enter the A-to-D converter 12, although there is no technical reason why this number cannot be increased. Generally speaking, games use 1 or 2 inputs, depending on whether the output of the game platform delivers mono, dual mono, or stereo. Also, standard CD players and other stereo sources use inputs 1 and 2. Television center and surround decoders may use up to all four inputs.

The A-to-D converter 12 is used to transform the analog waveforms of the input signals into pulse code modulated (PCM) output signals operating at a rate consistent with high-quality digital audio conversion in other systems. These output signals are transmitted through a low-pass filter 14 to create signals 16 having frequencies less than 100 Hz, which are transmitted to a bass pipe or subwoofer.

The output signal from the A-to-D converter 12 also passes through a series of parallel paths 18, 20, 22, and 24, each of which has discrete digital signal processing (DSP) elements. The parallel paths 18, 20, 22, and 24 are used in order to provide the fastest possible processing time for the output signal.

The first path 18 includes a block 26 that incorporates the functionality of both tapped delays and band pass filters that together provide the basic multi-speaker spreader effect from the second output signal.

The second path 20 includes an RMS (root-mean-square) level estimator 28 and a peak detector 30. The RMS level estimator 28 and peak detector 30 essentially identify whether an impulse has occurred in the second output signal. In order to separate steady state from impulses, the RMS level estimator 28 makes an estimate of the average or RMS levels of the second output signal, and the peak detector 30 makes a determination of the greatest amplitude of the second output signal. Peak detection includes the greatest amplitude in the second output signal within some recent period, as well as the greatest amplitude in the history of the signal, so there are two values updated at each sample.

In the third path 22 and fourth path 24, two Fast Fourier Transform (FFT) elements 32 and 34 provide for multi-rate filtering and analysis. The FFT 32 and short period FFT 34 generate wavelets to evaluate characteristics of the signal. If the wavelet transform were implemented in the pre-processing section, it would consist of filters and band sampling units.

From the FFTs 32 and 34, the signals are output to a power density estimator 36, spectrum analyzer 38, and Pythagoras processor 40. The power density estimator 36 indicates how much power is contained over a short period. The spectrum analyzer 38 analyzes the spectral power distribution for changes between adjacent samples. The Pythagoras processor 40 generates polar coordinates comprising both magnitude and phase for the signal. These elements comprise a spectral power distribution block, where the spectrum from the second output signal is examined for changes between adjacent samples and the density information is used in either a heuristic or learning algorithm to determine what kind of change has occurred.

The output from the RMS level estimator 28, peak detector 30, power density estimator 36, and spectrum analyzer 38 are weighted before being input to a decision matrix 42. The weighting blocks 44, 46, 48 and 50 are fuzzy logic inputs into the decision matrix 42 which then decides how to vector the signal based on all the criteria received as inputs. The output of the Pythagoras processor 40, which comprises both magnitude and phase for the second output signal, is directly inputted into the decision matrix 42.

The decision matrix 42 determines how fast the signals should be vectored and which speakers in the array should be chosen for the vector. The output from the decision matrix 42 is sent to a vector store 52 and regeneration function block 54.

The output of the vector store 52 and regeneration function block 54 comprise sixteen different channels, wherein each channel is transmitted to one of a plurality of adders 56, is then latched via output latch 58, and transmitted to a digital-to-analog converter 60. Finally, each channel is amplified by 62. The vector store 52 comprises a ROM with a lookup table therein. The output of the decision matrix 42 is input in the form of a word to the address lines of the decision matrix 42. The vector stored in the lookup table with that address is then output.

The regeneration function block 54 comprises logic for performing inverse transformations to change the matrix 52 output into a number suitable for conversion to audio signals.

CONCLUSION

This concludes the description of the preferred embodiment of the invention. The foregoing description of the preferred embodiment has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A sound spreader, comprising:

(a) one or more analog-to-digital converters for converting analog audio signals to digital output signals, (b) first, second, third and fourth digital signal processing paths for processing the digital output signals, wherein:

(1) the first digital signal processing path includes a block that incorporates functionality from both tapped delays and band pass filters that together provide a basic multi-speaker spreader effect from the digital output signals, (2) the second digital signal processing path includes an RMS (root-mean-square) level estimator and a peak detector for identifying whether an impulse has occurred in the digital output signals, and (3) the third and fourth second digital signal processing paths each include Fast Fourier Transform (FFT) elements for multi-rate filtering and analysis of the digital output signals and a spectral power distribution block for examining a spectrum from the digital output signal for changes between adjacent samples and for identifying density information to determine what kind of changes have occurred, and (c) means for weighting the outputs from the first, second, third and fourth digital signal processing paths as inputs to a decision matrix that decides how to vector the digital output signals in a three-dimensional manner through an array of speakers, thereby creating a three-dimensional acoustical effect within the array of speakers.

2. The sound spreader of claim 1, wherein the analog-to-digital converters are used to transform analog waveforms of the analog audio signals into pulse code modulated (PCM) digital output signals.

3. The sound spreader of claim 1, wherein the RMS level estimator makes an estimate of the average or RMS levels of the digital output signals in order to separate steady state information from impulse information.

4. The sound spreader of claim 1, wherein the peak detector makes a determination of an amplitude of the digital output signal.

5. The sound spreader of claim 1, wherein the peak detector makes a determination of a greatest amplitude of the digital output signal within a recent period, as well as a greatest amplitude in a history of the digital output signal.

6. The sound spreader of claim 1, wherein the FFT elements generate wavelets to evaluate characteristics of the digital output signal.

7. The sound spreader of claim 1, wherein the spectral power distribution block includes a power density estimator, a spectrum analyzer, and a Pythagoras processor.

8. The sound spreader of claim 7, wherein the power density estimator indicates how much power is contained in the digital output signal over a short period.

9. The sound spreader of claim 7, wherein the spectrum analyzer analyzes a spectral power distribution for the digital output signal to identify changes between adjacent samples.

10. The sound spreader of claim 7, wherein the Pythagoras processor generates polar coordinates comprising both magnitude and phase for the digital output signal.

11. The sound spreader of claim 7, wherein the decision matrix determines how fast the digital output signals should be vectored and which speakers in the array should be chosen for the vectored digital output signals.

12. The sound spreader of claim 7, wherein the output from the decision matrix is sent to a vector store and regeneration function block.

13. The sound spreader of claim 12, wherein the output of the vector store and regeneration function block comprises a plurality of channels, wherein each channel is transmitted to one of the speakers in the array.

14. A sound spreader, comprising:

(a) means for accepting audio input signals;

(b) means for separating background sounds from impulse sounds in the audio input signals;

(c) means for evaluating the separated impulse sounds and for choosing a trajectory for vectoring the separated impulse sounds across a plurality of speakers; and, (d) means for spreading the separated background sounds around to all of the speakers in the array so that noise is spread evenly throughout a plurality of output channels.

15. The sound spreader of claim 14, wherein the means for evaluating and for separating further comprises means for processing the impulse sounds so that they are vectored in a three-dimensional manner through the array of speakers, thereby creating a three-dimensional acoustical effect within the array of speakers.

16. The sound generating apparatus of claim 15, wherein the vectored impulse sounds are determined algorithmically.

17. The sound generating apparatus of claim 15, wherein the vectored impulse sounds are determined by means of a lookup table.

18. The sound spreader of claim 14, wherein the means for evaluating and for separating further comprises means for processing the impulse sounds so that they are vectored through the array of speakers to effect a multi-speaker pan, so the impulse sounds move from one or more of the speakers to one or more of the speakers in the array.

* * * * *